US006587817B1

(12) United States Patent
Vähätalo et al.

(10) Patent No.: US 6,587,817 B1
(45) Date of Patent: Jul. 1, 2003

(54) METHOD AND APPARATUS FOR DETERMINING SPEECH CODING PARAMETERS

(75) Inventors: Antti Vähätalo, Tampere (FI); Erkki Paajanen, Tampere (FI)

(73) Assignee: Nokia Mobile Phones Ltd., Espoo (FI)

( * ) Notice: Subject to any disclaimer, the term of this patent is extended or adjusted under 35 U.S.C. 154(b) by 0 days.

(21) Appl. No.: 09/478,877

(22) Filed: Jan. 7, 2000

(30) Foreign Application Priority Data

Jan. 8, 1999 (FI) ..... 990033

(51) Int. Cl.[7] ..... G10L 19/14
(52) U.S. Cl. ..... 704/211; 704/221; 704/227
(58) Field of Search ..... 704/211, 221, 704/224, 227

(56) References Cited

U.S. PATENT DOCUMENTS

| | | | | |
|---|---|---|---|---|
| 5,732,389 A | | 3/1998 | Kroon et al. | 704/223 |
| 5,774,846 A | * | 6/1998 | Morii | 704/232 |
| 5,839,101 A | | 11/1998 | Vahatalo et al. | 704/226 |

FOREIGN PATENT DOCUMENTS

GB 2326572 A 12/1998

OTHER PUBLICATIONS

"Investigating the Use of Asymmetric Windows in Celp Vocoders", Dinei A. F. Florencio, IEEE International Conference On Acoustics, Speech and Signal Processing, vol. 2, pp 427–430, 1993.

"On the Use of Asymmetric Windows for Reducing the Time Delay in Real–Time Spectral Analysis", Dinei A. F. Florencio International Conference On Acoustics, Speech and Signal Processing, vol. 5, pp 3261–3264, 1991.

"New Speech Enhancement Techniques For Low Bit Rate Speech Coding", R. Martin et al., IEEE Workshop on Speech Coding Proceedings, pp 165–167, 1999.

* cited by examiner

*Primary Examiner*—Marsha D. Banks-Harold
*Assistant Examiner*—Donald L. Storm
(74) *Attorney, Agent, or Firm*—Perman & Green, LLP

(57) ABSTRACT

A method which comprises forming a first noise reduction frame (18) containing speech samples; which is windowed by a first window function. For the windowed frame, noise reduction is performed for producing a second noise reduction frame (19; 45). A speech coding frame (44) to be formed comprises noise-reduced samples of at least two successive second noise reduction frames (45, 46), partly summed with one another. On the basis of said speech coding frame (44), a set of speech coding parameters $p_j$ are determined. A lookahead part (42) of the speech coding frame is at least partly formed of a first slope (41), the first slope (10, 41) comprising a set of most recent noise-reduced samples of the second noise reduction frame, not summed with the samples of any other second noise reduction frame. The method reduces the delay caused by speech coding and noise reduction.

13 Claims, 4 Drawing Sheets

METHOD AND APPARATUS FOR DETERMINING SPEECH CODING PARAMETERS

FIELD OF THE INVENTION

The present invention relates to speech coding and in particular to forming of speech coding frames.

BACKGROUND OF THE INVENTION

A delay is generally a period between one event and another event connected with it. In mobile communication systems, a delay occurs between the transmission of a signal and its reception, the delay resulting from the interaction of a number of different factors, for example, from speech coding, channel coding and the propagation delay of the signal. Long response times produce an unnatural feeling in conversation and, therefore, a delay caused by the system always makes communication more difficult. Thus, the aim is to minimise the delay in each part of the system.

One source of a delay is windowing used in signal processing. The purpose of windowing is to shape the signal into a form required in further processing. For example, noise reducers typically used in mobile communication systems mainly operate in the frequency domain and, therefore, a signal to be noise-reduced is usually transformed frame by frame from the time domain to the frequency domain using a Fast Fourier Transform (FFT). In order that the FFT functions in the desired way, samples divided into frames should be windowed prior to the FFT.

FIG. 1 illustrates the procedure by showing as an example the windowing of a frame F(n) into a trapezoidal form. In windowing, the set of samples contained in the frame F(n) is multiplied by a window function so that a window W(n) 19 resulting from this comprises a first slope 10 (hereinafter referred to as the front slope), containing more recent samples of the frame, a second slope 11 (hereinafter referred to as the rear slope), containing older samples of the frame, and a remaining window part 12 in between them. In the windowing of the example, the samples of the window part 12 that locates between the first and second slopes are multiplied by 1, i.e. their value remains unchanged. The samples of the front slope 10 are multiplied by a descending function where the coefficient of the oldest samples of the front slope 10 approaches one and the coefficient of the newest samples approaches zero. Correspondingly, the samples of the rear slope 11 are multiplied by an ascending function where the coefficient of the oldest samples of the rear slope 11 approaches zero and the coefficient of the newest samples approaches one.

For the noise reduction of speech encoders, the noise reduction frame F(n) (reference 18) is typically formed of an input frame 16, formed of new samples, and of a set of the oldest samples 15 of the preceding input frame. Thus, samples 17 are used in forming two successive input frames. FIG. 1 also illustrates the overlap-add method often used in connection with windowing relating to FFTs. In the method, part of the noise-reduced samples of successive windowed noise reduction frames are summed with each other to improve adjustments between consecutive frames. In the example shown in FIG. 1, the noise-reduced samples of slopes 10 and 13 of successive frames F(n) and F(n+1) are summed so that the data of the front slope 10, calculated from the newer samples of the frame F(n), is summed sample by sample with the slope 13, calculated from the older samples of the frame F(n+1), so that the sum of the coefficients of overlapping slopes is 1. Due to the overlap-add method, the section represented by the front slope 10 cannot, however, be transmitted further from noise reduction before noise reduction is performed for the entire following frame F(n+1) and neither can noise reduction of the next frame F(n+1) be started before the entire next frame is received. Thus, the use of the overlap-add method in the processing of a signal causes an additional delay D1, which is equal to the length of slope 10.

The simplified block diagram in FIG. 2 illustrates the phases of processing for a signal being formed of samples divided into frames, according to prior art. Block 21 represents the windowing of a frame, as presented above and block 22 represents the performance of noise reduction algorithms for windowed frames, comprising at least an FFT being performed on the windowed data and its reverse transformation. Block 23 represents the operations performed according to an overlap-add windowing wherein noise-reduced data is stored for the first slopes 10, 14 of the window, to wait for the processing of the next frame and wherein the stored data is summed with the data of the second slopes 13 of the next frame. Block 24 represents speech-coding related signal pre-processing, which typically comprises high-pass filtering and signal scaling for speech coding. From block 24, the data is transferred to a block 25 for speech coding.

Speech codecs (e.g. CELP, ACELP), used in current mobile phone systems, are based on linear prediction (CELP=Code Excited Linear Prediction). In linear prediction, a signal is encoded frame by frame. The data contained in the frames is windowed and on the basis of the windowed data, a set of auto-correlation coefficients is calculated, which are to be used to determine the coefficients of a linear prediction function to be used as coding parameters.

Lookahead is a known procedure used in data transmission, wherein typically newer data that does not belong to the frame to be processed are utilised, e.g. in a procedure applied to a speech frame. In some speech coding algorithms, such as algorithms according to the IS-641 standard specified by the Electronic Alliance/ Telecommunications Industry Association (EIA/TIA), linear prediction (LP) parameters for speech coding are calculated from a window that contains, in addition to the frame to be analysed, samples that belong to the preceding and following frame. The samples that belong to the following frame are called lookahead samples. A corresponding arrangement has also been proposed for use, e.g. in connection with Adaptive Multi Rate (AMR) codecs.

FIG. 3 illustrates lookahead as used in linear prediction according to the IS-641 standard. Each 20-ms long speech frame 30 is windowed into an asymmetric window 31 that also contains samples belonging to the preceding and following frame. The part of window 31 formed of newer samples is called the lookahead part 32. An LP analysis is made once for each window. As can be seen in FIG. 3, windowing relating to lookahead causes an algorithmic delay D2 in the signal corresponding to the length of the lookahead part 32. Since the arrival of the signal for speech coding is already delayed by a period D1 as a result of noise reduction windowing, the delay D2 is summed with the previously described noise reduction additional delay D1.

SUMMARY OF THE INVENTION

According to the invention a method for generating a speech coding frames, the method comprising the steps of:

forming a series of partly overlapping first frames containing speech samples;

processing a first frame of the series of first frames by a first window function for producing a second, windowed, frame having a first slope;

performing noise reduction on the second frame for producing a third frame comprising noise reduced speech samples; and forming a speech coding frame comprising noise-reduced samples of two successive third frames, at least partly summed with one another characterised in that the method further comprises the steps of:

forming the speech coding frame so that it has a lookahead part that is formed at least partly of noise reduced speech samples of the first slope, these noise reduced speech samples of the first slope being not summed with any other noise reduced speech samples of the speech coding frame to be formed.

Advantageously, the above-described joint effect of algorithmic delays can be reduced by the invented method and an apparatus implementing the method.

Advantageously, by utilising windowing already performed in noise reduction in speech coding windowing, the algorithmic delays caused by processing phases are not summed with each other.

A speech encoder according to the invention is described in claim 10 and a mobile station according to the invention is described in claim 13. The embodiments of the invention are described in the dependent claims.

BRIEF DESCRIPTION OF THE DRAWINGS

The invention is explained below in more detail by referring to the enclosed drawings, in which.

DETAILED DESCRIPTION

Figure 1:
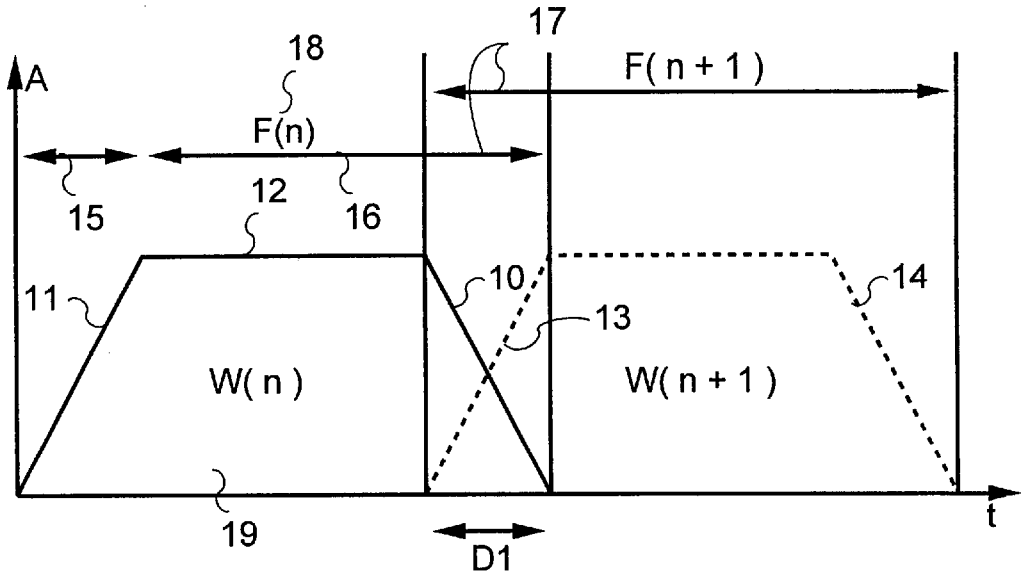
FIG. 1 illustrates windowing by presenting, as an example, the windowing of a frame F into a trapezoidal form (prior art)
Figure 2:
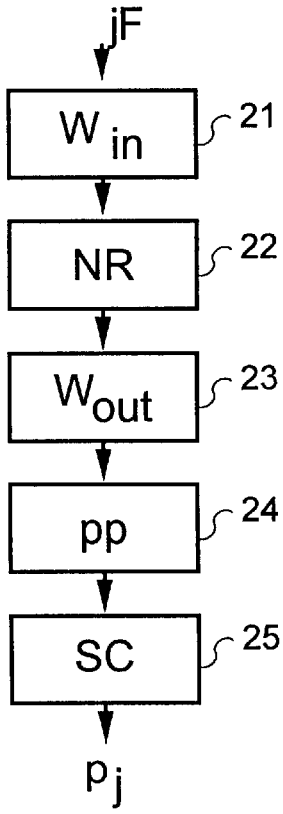
FIG. 2 illustrates, the processing of a signal formed of samples divided into frames in the form of a block diagram (prior art)
Figure 3:
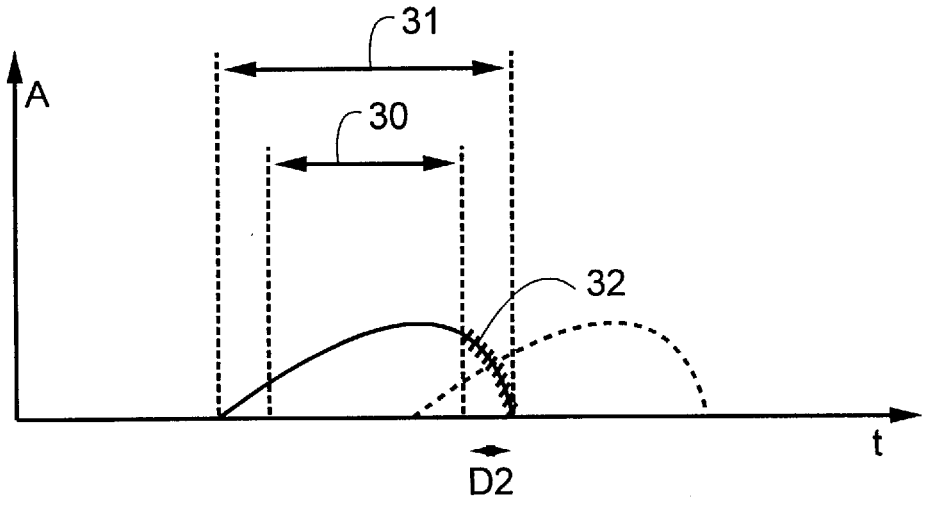
FIG. 3 illustrates lookahead in a linear prediction according to the IS-641 standard (prior art)

FIGS. 1 to 3 have been described above.

Figure 4:
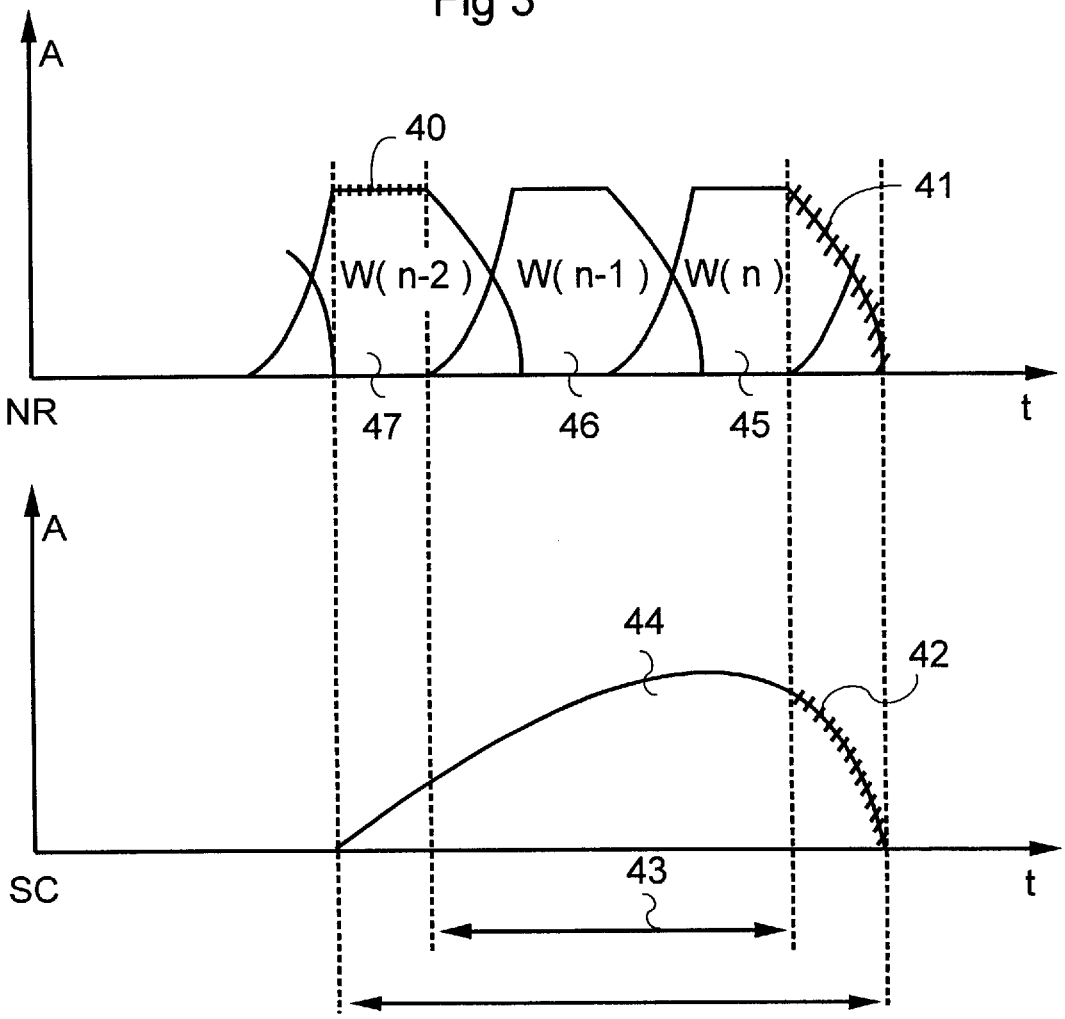
FIG. 4 illustrates the principle of the invention in a simplified form.

FIG. 4 illustrates, in a simplified form, the principle of reducing the algorithmic delay in speech coding according to the invention. The time axis NR describes windowing used in noise reduction 22 and the time axis SC describes windowing to be used in speech coding 25. The ratio between the lengths of the frames used in noise reduction and speech coding is not relevant to the invention, but preferably the length of a speech coding frame is a multiple of the sum of the rear slope 11 and the window part 12 of the noise reduction frame 19. Thus, the length of a speech coding frame is said sum multiplied by an integer N=1, 2, . . . In the presented embodiment, speech coding windowing according to the IS-641 standard is used and it is assumed that the windowing used in noise reduction is such that the length of the frame used in speech coding is twice the length of the frame used in noise reduction, without restricting the invention to the selected lengths or their ratio. In the presented embodiment, a function with a cosinusoidal form is used in the noise reduction window slope and the speech coding window is an asymmetric window formed from a Hamming window and a window function formed using the cosine function:

$$w(n) = 0{,}54 - 0{,}46\cos\left(\frac{2\pi n}{2L_1 - 1}\right) \quad n = 0, \ldots, L_1 - 1 \tag{1}$$

$$w(n) = \cos\left(\frac{2\pi(n - L_1)}{4L_2 - 1}\right) \quad n = L_1, \ldots, L_1 + L_2 - 1$$

where n is the index of a sample in the window, $L_1$=200, $L_2$=40.

In a solution according to prior art, the delay D1 caused by noise reduction overlap-add windowing corresponding to the length of the slope 41 and the delay D2 required for speech coding lookahead the length of the slope 42 affect the processing of a signal. In a solution according to the invention, the slope 41 calculated in noise reduction windowing is utilised in speech coding lookahead, whereby a speech frame can be analysed and encoded immediately when the noise-reduced samples to be encoded and the slope 41 obtained from noise reduction windowing relating thereto are received in the speech coding block 25. In this case, the delay D1 caused by noise reduction is not summed with the delay D2 caused by speech coding windowing but, instead, it merges with the algorithmic delay caused by lookahead, such that the overall algorithmic delay of the processes is smaller than in the solution according to prior art. The arrangement according to the invention is possible because, in lookahead, samples contained in the lookahead part are only used as auxiliary information when analysing the frame to be encoded, i.e. an output signal is not expressly formed on the basis of samples contained in the lookahead part.

In order to achieve the effect according to the invention, the noise reduction windowing slope 41 relating to newest samples 43 of the speech coding frame to be formed is transferred together with noise-reduced samples 40, 43 for speech coding. Noise reduction windowing and speech coding windowing are preferably arranged to overlap in time so that at least one noise reduction windowing slope 41 coincides at least partly with the lookahead part 42 of each speech coding frame.

In the embodiment shown in FIG. 4, the front slopes of the window used in speech coding and of the window used in noise reduction have the same length and the same windowing function is used for the front slopes, i.e. the slopes are identical. As far as the invention is concerned, this is a computationally preferred alternative because, in this case, the slope obtained from noise reduction windowing can directly be utilised as a lookahead part of speech coding and the algorithmic delay is reduced without necessitating additional processing. For example in the case shown in FIG. 4, a speech coding window 44 is formed, according to the invention, from the noise-reduced samples 40 of a window w(n−2) 47, from the noise-reduced samples 43 of two noise reduction windows w(n), w(n−1) (references 46, 45) and of the noise-reduced windowing slope 41 relating to the samples of the window w(n) 45. The noise-reduced samples 40, 43 are processed by the speech coding windowing function and auto-correlation analysis is made on the basis of the window 44 formed from the windowed samples 40, 43 and said slope 41. In this case, the delay whose length is the length of the slope 41, caused by noise reduction, merges with the delay caused by speech coding lookahead, and their joint effect is reduced.

Figure 5:
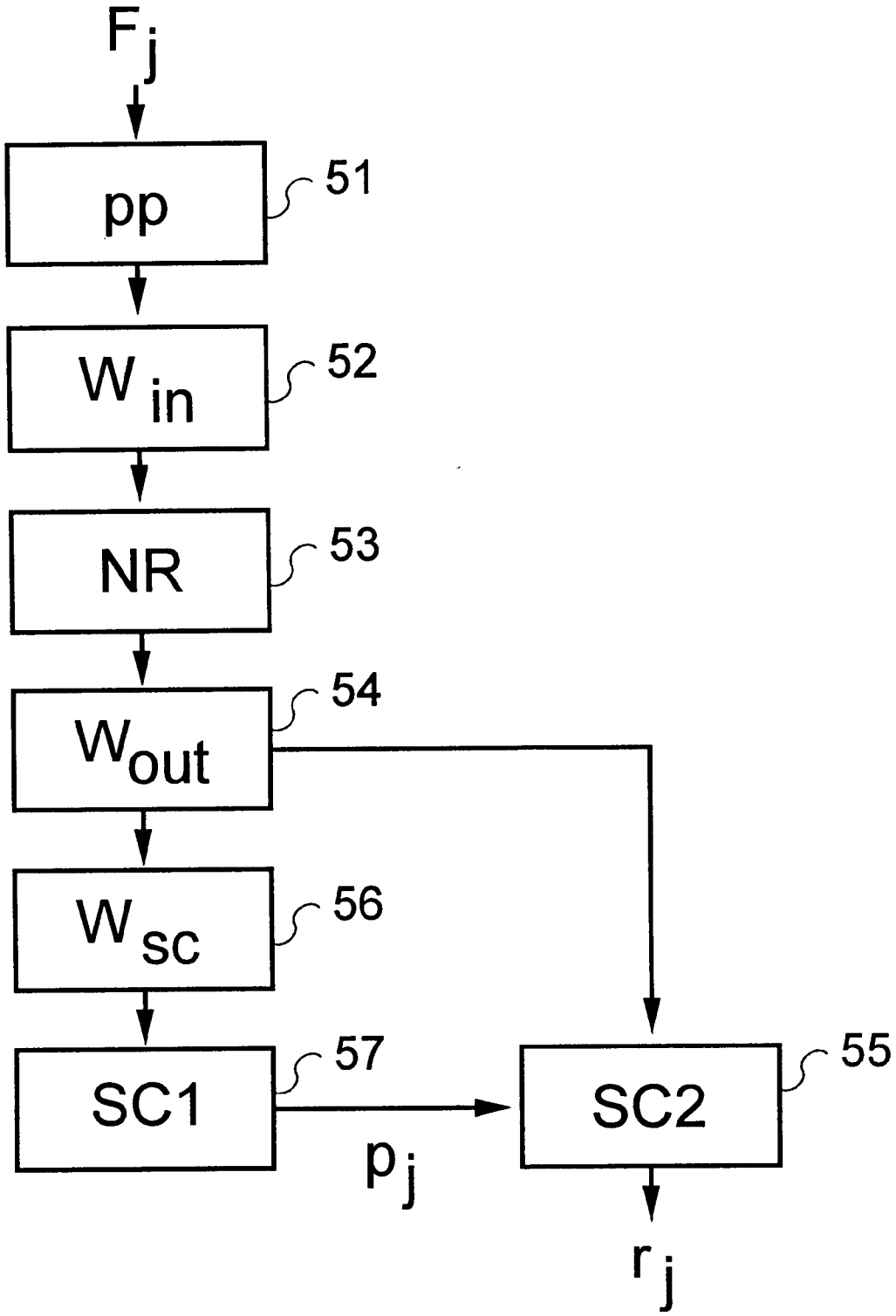
FIG. 5 illustrates the method according to the invention in the form of a flow diagram.

The block diagram in FIG. 5 illustrates a method, according to the invention, for processing speech. Step 51 represents signal pre-processing relating to speech coding, which in prior art is known to comprise high-pass filtering and signal scaling for the speech coding phase. In step 52, pre-processed samples are processed by a first window function as presented above. Step 53 describes the performance of noise reduction algorithms for windowed frames, comprising at least an FFT and its reverse transformation being performed on the windowed data. Step 54 describes operations according to the overlap-add method, where noise-reduced and windowed samples are stored and summed as presented above. After step 54, the method comprises two different branches, a first branch 55 which comprises speech coding algorithms, wherein the frame does not have to be windowed, and a second branch 56, 57 comprising speech coding algorithms (e.g. LPC), wherein windowing is required.

In the second speech coding branch, a second window is formed (step 56) utilising noise-reduced samples. In the method according to the invention, the second window is formed from a given number of received noise-reduced samples and from the front slope of noise reduction windowing relating to the newest received samples. Because pre-processing of a noise-reduced slope would require several additional steps, pre-processing is thus carried out in step 51 before noise reduction windowing and noise reduction as distinct from prior art. A set of speech coding parameters $p_j$ (e.g. LP parameters) are calculated (step 57) on the basis of the second window, which parameters are transferred into the first speed coding branch 55 for other speech coding algorithms. Speech coding parameters $r_j$ generated in the first branch 55 enable the reconstruction of speech with a decoder corresponding to an encoder, according to prior art.

However, the utilisation of the invention is not merely restricted to uniform windows but also different ratios of length and shape (i.e. of the windowing functions used at the slopes) are possible. If the duration of the front slope 41 containing the newest samples of noise reduction is as long as the speech coding lookahead part 42, but said front slope 41 and the lookahead part 42 have different shape, the front slope 41 to be transferred must be multiplied sample by sample in block 54 or the transferred front slope 41 must be multiplied in block 56 by a correction function that compensates for the difference between the functions used in windowing. In this case, the reduction of the algorithmic delay causes a computational delay in the process which, however, typically has a smaller effect than the algorithmic delay to be reduced.

The lengths of the noise reduction front slope and lookahead part can be different from each other. If the front slope of the noise reducer is longer than the lookahead part, the algorithmic delay is naturally determined according to said front slope. In addition, the samples of the front slope, or the part of the front slope that is utilised in lookahead, must be multiplied sample by sample by a correction function that compensates for the difference between the functions used in windowing. If the front slope 41 of a noise reducer is shorter than the lookahead part 42, said front slope 41 and the required number of new samples following it are transferred for speech coding 25 in order to complete the length of the lookhead part. The front slope obtained from noise reduction and the following samples must again be processed by a correction function that compensated the difference.

Figure 6:
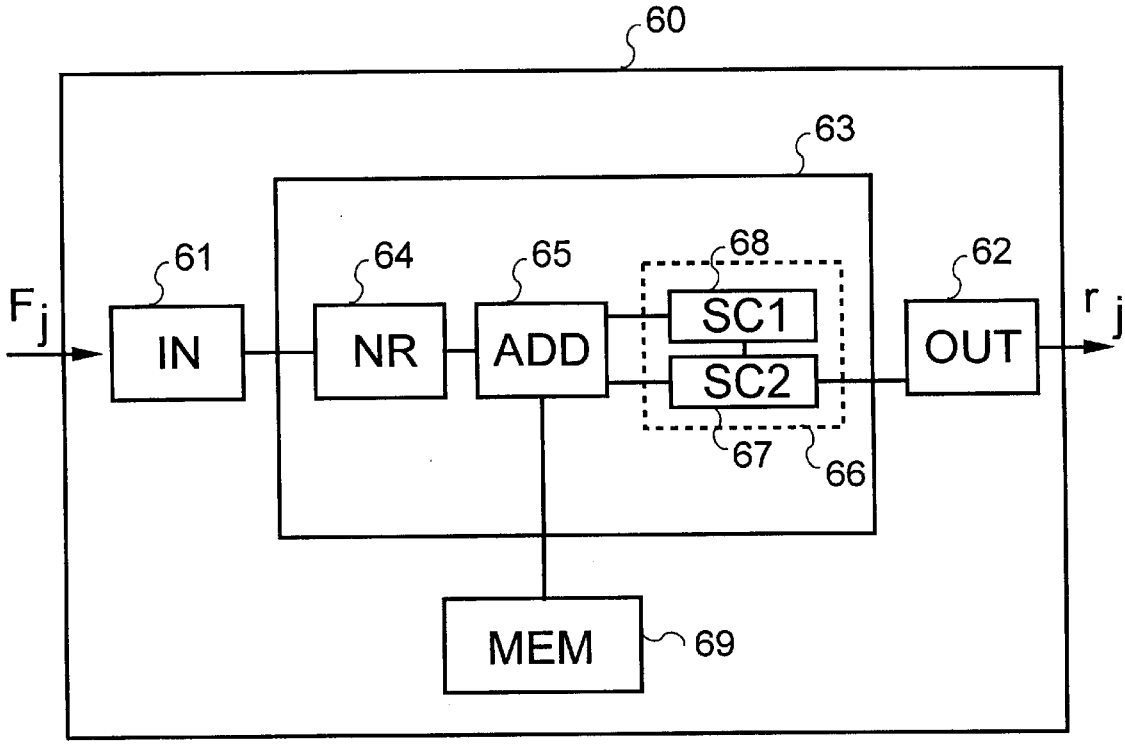
FIG. 6 illustrates the functionalities of a speech encoder according to the invention in the form of a block diagram.

The block diagram in FIG. 6 illustrates the functionalities of a speech encoder according to the invention. The encoder 60 comprises an input 61 for receiving a frame $F_j$, containing samples determined from speech, and an output 62 for providing speech parameters $r_j$, determined on the basis of the samples. The input 61 is arranged to pre-process the received frames for speech coding and to window the frames into a preferred shape for noise reduction. The encoder further comprises processing means 63 adapted to carry out operations for determining the speech parameters on the basis of the windowed noise reduction frames received from the input 61. The processing means comprise a noise reducer 64, wherein the received noise reduction frames are processed by a specific noise reduction algorithm. The noise-reduced frames are sent to an adder 65 which is connected to a memory 69 for storing samples contained in successive noise reduction frames, at least as regards the front slopes of noise reduction windowing. Samples of successive noise reduction frames are summed with each other by the adder 65 to improve the way in which successive frames fit together, preferably the front slope 10 of the preceding noise reduction frame is summed with the rear slope 13 of the noise reduction frame to be processed. The processing means also comprise a coding element 66. The coding element 66, according to the invention, comprises two different branches, a first branch 67 which comprises speech coding algorithms wherein a frame does not have to be windowed, and a second branch 68 that comprises speech coding algorithms (e.g. LPC) wherein windowing is required. The adder 65, according to the invention, is arranged to transfer the front slope 10 of the noise reduction window corresponding to the newest samples of the speech coding frame to be formed at least to the second branch 68 of the coding element 66 for windowing in the second speech coding branch. In the second branch 68, said slope is utilised as presented above in the formation of a second window, whereupon the joint effect of the algorithmic delays caused by noise reduction windowing and speech coding windowing is reduced. By means of said speech coding algorithms to be performed in the first 67 and second analysing branch 68, the speech coding parameters $r_j$ are determined in a manner known to a person skilled in the art, enabling the reconstruction of speech by a decoder corresponding to the encoder. A more detailed description of the functionalities of prior art presented above can be found, e.g. in the EIA/TIA Standard IS-641.

Figure 7:
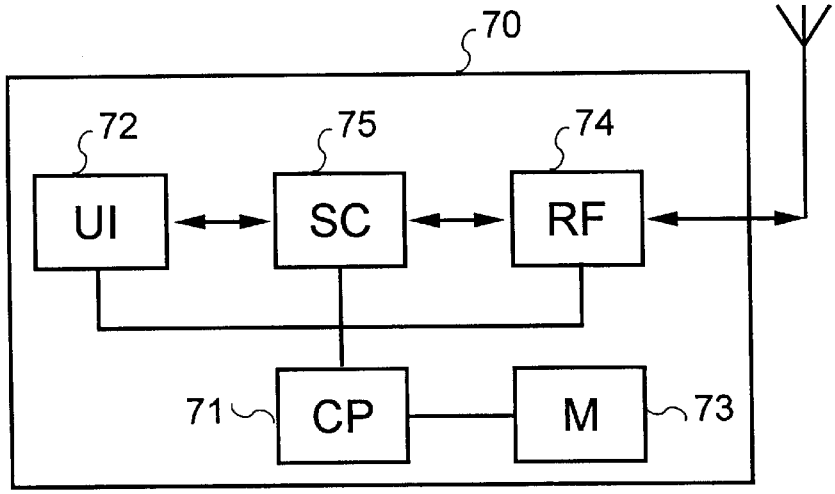
FIG. 7 illustrates a mobile station according to the invention in the form of a block diagram.

The block diagram in FIG. 7 illustrates a mobile station 70 according to the invention. The mobile station comprises a central processing unit 71 which controls the mobile station's various functions, a user interface 72 (typically at least a keyboard, a display, a microphone, and a loudspeaker) to enable communication with a user, and a memory 73 which is typically formed of at least a non-volatile and volatile memory. In addition, the mobile station comprises a radio part 74 to enable communication with the network part of a mobile communication system. In mobile communication systems, speech is transferred in a coded form and, therefore, there is preferably a codec 75 in between the radio part 74 and the user interface 72, the codec comprising an encoder for encoding speech and a decoder for decoding speech. On the basis of samples taken from a speech signal received via the user interface 72, a set of speech parameters are computed by the encoder for transmission to a receiver via the radio part 74. Correspondingly, speech parameters received via the radio part are decoded and, on the basis of the decoded parameters, the received speech is reconstructed for output via the user interface 72. As presented above, the codec of a mobile station, according to the invention, comprises means 63,69 for utilising a first windowing slope determined in noise reduction when performing windowing in connection with speech coding algorithms.

This paper presents the implementation and embodiments of the present invention with the help of examples. A person skilled in the art will appreciate that the present invention is not restricted to details of the previously presented embodiments, and that the invention can also be implemented in another form without deviating from the characteristics of the invention. The embodiments presented above should be considered illustrative, but not restricting. Thus, the possibilities of implementing and using the invention are only restricted by the enclosed claims. Consequently, the various alternatives for implementing the invention as determined by the claims, including the equivalent implementations, also belong to the scope of the invention.

What is claimed is:

1. A method for generating a speech coding frames the method comprising the steps of:

forming a series of partly overlapping first frames containing speech samples;

processing a first frame of the series of first frames by a first window function for producing a second, windowed, frame having a first slope;

performing noise reduction on the second frame for producing a third frame comprising noise reduced speech samples;

forming a speech coding frame comprising noise-reduced samples of two successive third frames, at least partly summed with one another so that the speech coding frame has a lookahead part that is formed at least partly of noise reduced speech samples of the first slope, these noise reduced speech samples of the first slope being not summed with any other noise reduced speech samples of the speech coding frame to be formed.

2. A method according to claim 1, wherein before the formation of said speech coding frame, said noise-reduced samples are processed by a second window function.

3. A method according to claim 2, wherein the first window function and the second window function are arranged to produce the same result when directed to the samples of the first slope.

4. A method according to claim 2, wherein the first window function and the second window function are arranged to produce a different result when directed to the samples of the first slope whereupon, also in the method, the samples of the first slope are processed by a specific correction function.

5. A method according to claim 1, wherein at least some of the noise reduced speech samples of the lookahead part equal to noise reduced speech samples of the first slope.

6. A method according to claim 1, wherein the third frame comprises a second slope corresponding to the first slope, processed from the frame's earlier samples, and that the method further comprises:

summing the samples of the second slope of the third frame to be processed with the noise-reduced samples of the first slope of the preceding third frame (overlap-add).

7. A method according to claim 1, wherein at least some of the noise reduced speech samples of the lookahead part are formed with a correction function of the noise reduced speech samples of the first slope.

8. A method according to claim 1, wherein a set of linear prediction parameters are determined on the basis of the speech coding frame.

9. A method according to claim 1, wherein pre-processing of speech samples is performed before noise reduction.

10. A speech encoder comprising an input element for forming a series of partly overlapping first frames containing speech samples;

a means for processing a first frame of the series of first frames by a first window function for a forming second, windowed, frame having a first slope;

a noise reducer for performing noise reduction on the second frame for forming a third frame comprising noise-reduced samples;

a coding element which comprises a means for forming a speech coding frame, the speech coding frame comprising noise-reduced samples of two successive third frames at least partly summed with one another, and means for determining speech coding parameters on the basis of said speech coding frame;

wherein the coding element further comprises a means for forming the speech coding frame so that the speech coding frame has a lookahead part which is formed at least partly of the first slope, the noise-reduced speech samples of the first slope being not summed with any other noise reduced speech samples of the speech coding frame to be formed.

11. A speech encoder according to claim 10, wherein said coding element comprises a means for processing said noise-reduced samples by a second window function in connection with the formation of the speech coding frame.

12. An encoder according to claim 10, wherein the third frame comprises a second slope corresponding to the first slope, processed from earlier samples, and the encoder further comprises an adder for summing up the noise-reduced samples of the second slope of the third frame to be processed with the noise-reduced samples of the first slope of the preceding third frame (overlap-add).

13. A mobile station having a speech encoder comprising:

an input element for forming a series of partly overlapping first frames containing speech samples;

a means for processing a first frame of the series of first frames by a first window function for a forming second, windowed, frame having a first slope;

a noise reducer for performing noise reduction on the second frame for forming a third frame comprising noise-reduced samples;

a coding element which comprises a means for forming a speech coding frame, the speech coding frame comprising noise-reduced samples of two successive third frames at least partly summed with one another, and means for determining speech coding parameters on the basis of said speech coding frame;

wherein the coding element further comprises a means for forming the speech coding frame so that the speech coding frame has a lookahead part which is formed at least partly of the first slope, the noise-reduced speech samples of the first slope being not summed with any other noise reduced speech samples of the speech coding frame to be formed.

* * * * *